US007429045B2

(12) United States Patent
Darling

(10) Patent No.: US 7,429,045 B2
(45) Date of Patent: Sep. 30, 2008

(54) METHOD AND DEVICE FOR PLAYING A GAME IN WHICH VALUES OF GAME PIECES ARE GRADUALLY REVEALED

(76) Inventor: Richard Darling, 138 S. Zurich Ave., Egg Harbor City, NJ (US) 08215

( * ) Notice: Subject to any disclaimer, the term of this patent is extended or adjusted under 35 U.S.C. 154(b) by 81 days.

(21) Appl. No.: 11/190,294

(22) Filed: Jul. 27, 2005

(65) Prior Publication Data

US 2007/0024001 A1 Feb. 1, 2007

(51) Int. Cl.
*A63F 1/10* (2006.01)

(52) U.S. Cl. ..... 273/148 A; 273/429; 434/348; 446/147

(58) Field of Classification Search ..... 273/148 R, 273/148 A, 243, 248–254, 287, 429–432; 434/348; 446/147–152, 80
See application file for complete search history.

(56) References Cited

U.S. PATENT DOCUMENTS 3,224,112 A * 12/1965 Hanson ..... 273/270
4,457,106 A * 7/1984 Forquer ..... 49/158
5,056,793 A * 10/1991 Sigle ..... 273/282.2
5,288,075 A * 2/1994 Kelley ..... 273/243
5,386,999 A * 2/1995 Rice ..... 273/287
5,632,486 A 5/1997 Mkrtchyan ..... 273/292
6,652,286 B1 * 11/2003 Larsen ..... 434/348

* cited by examiner

*Primary Examiner*—Benjamin H Layno
(74) *Attorney, Agent, or Firm*—Mathews, Shepherd, McKay & Bruneau, P.A.

(57) ABSTRACT

The present invention relates to a method and device for playing a game in which values of a game piece are gradually revealed. In one embodiment, a housing receives a game piece. The housing includes an opaque portion covering markings on the game piece. The opaque portion is movable for gradually revealing at least one marking on the game piece. The opaque portion can include a pair of movable doors. The doors are moved laterally toward one another to reveal markings on outer columns of the game piece. The doors are moved vertically for revealing markings on an inner column of the game piece.

20 Claims, 14 Drawing Sheets

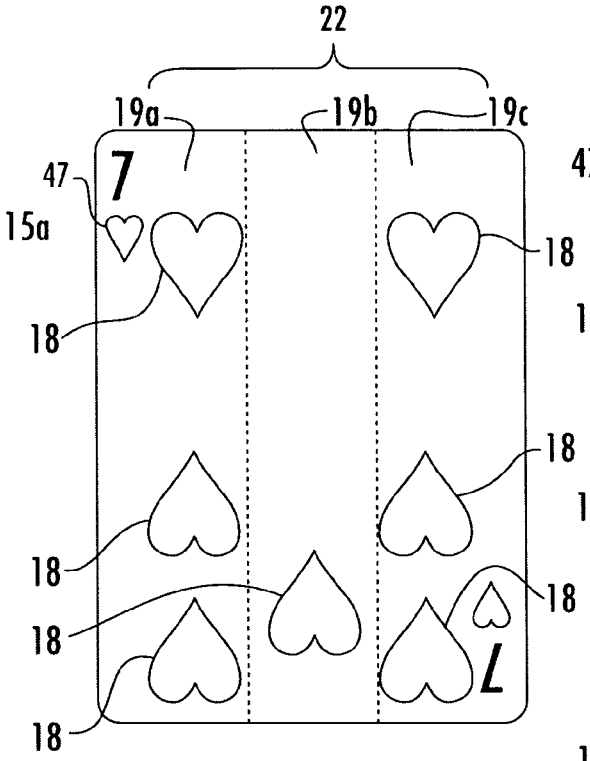
FIG. 2G
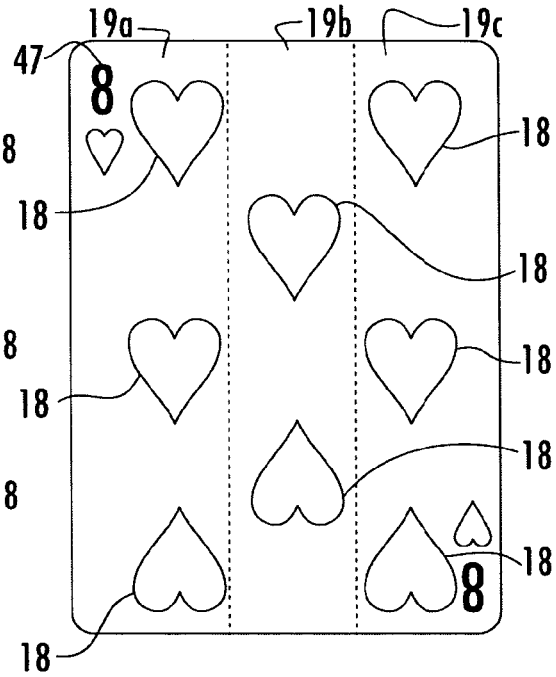
FIG. 2H
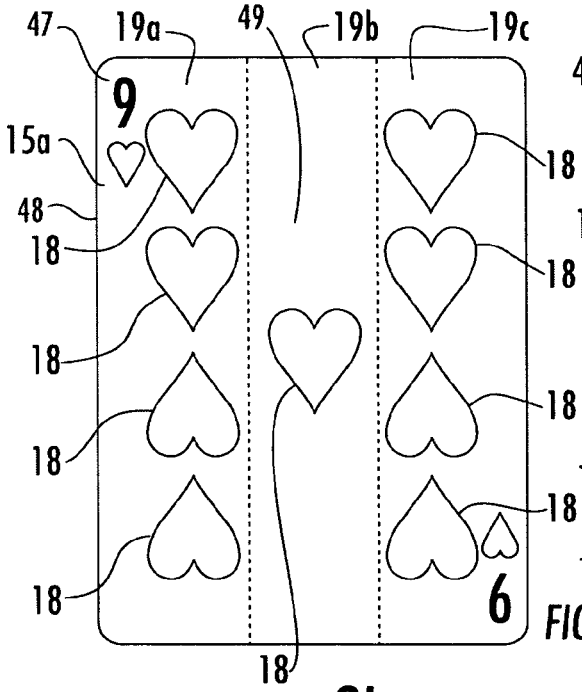
FIG. 2I
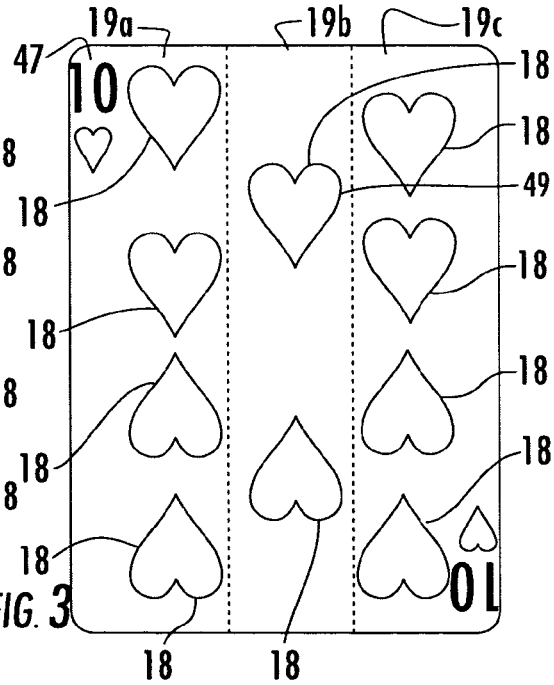
FIG. 3
FIG. 2J

METHOD AND DEVICE FOR PLAYING A GAME IN WHICH VALUES OF GAME PIECES ARE GRADUALLY REVEALED

BACKGROUND OF THE INVENTION

1. Field of the Invention

The invention relates to games, such as a game in which a value of game pieces are gradually revealed.

2. Description of Related Art

Variations in card games using card point values are known. In games such as black jack, a point value of cards is each player's hand is added together to determine the value of the hand after the player had the opportunity to be dealt additional cards. Different hands are compared to determine the winning hand, such as comparing the hand against the dealer hand.

U.S. Pat. No. 5,632,486 describes a method of playing a card game using a card number subtracting technique in which cards of the playing deck are assigned numerical point values. Eights, nines and tens are removed from the standard deck to establish a deck of forty cards. Each numbered card is assigned its point value. Each ace is assigned a value of one. Each face card is assigned a value of zero. Two cards are initially dealt to each player with each player having the option of receiving a third card. If a third card is dealt, one of the cards is discarded. The hands are compared to determine a winning hand as the hand in which the point value difference between the two cards in the hand is closest to zero.

It is desirable to provide a device for enhancing a player's interest during playing of a card game.

SUMMARY OF THE INVENTION

The present invention relates to a method and device for playing a game in which values of a game piece are gradually revealed. In one embodiment, a housing receives a game piece. The housing includes an opaque portion covering markings on the game piece. The opaque portion is movable for gradually revealing at least one marking on the game piece. The opaque portion can include a pair of movable doors. The doors are moved laterally toward one another to reveal markings on outer columns of the game piece. The doors are moved vertically for revealing markings on an inner column of the game piece. For example, the game piece can be a conventional card and representatives of a suit of the card are gradually revealed with the revealer device.

In an alternate embodiment, game pieces are slid into or under a revealer device. The revealer device includes one or more opaque portions to cover one or more markings on the game piece. The opaque portions can be individually rotated or slid to reveal the markings on the game piece.

In an alternate embodiment, a revealer device includes a circular housing including a radial slot. A circular game piece includes a radial slot. Values are formed on the game piece. The slot of the circular housing is placed adjacent the slot of the game piece. Rotation of the circular housing reveals the values on the game piece.

The invention will be more fully described by reference to the following drawings.

BRIEF DESCRIPTION OF THE DRAWINGS

FIGS. 2A-2J are schematic diagrams of game pieces which can be used with the device of the present invention.

DETAILED DESCRIPTION

Figure 1:
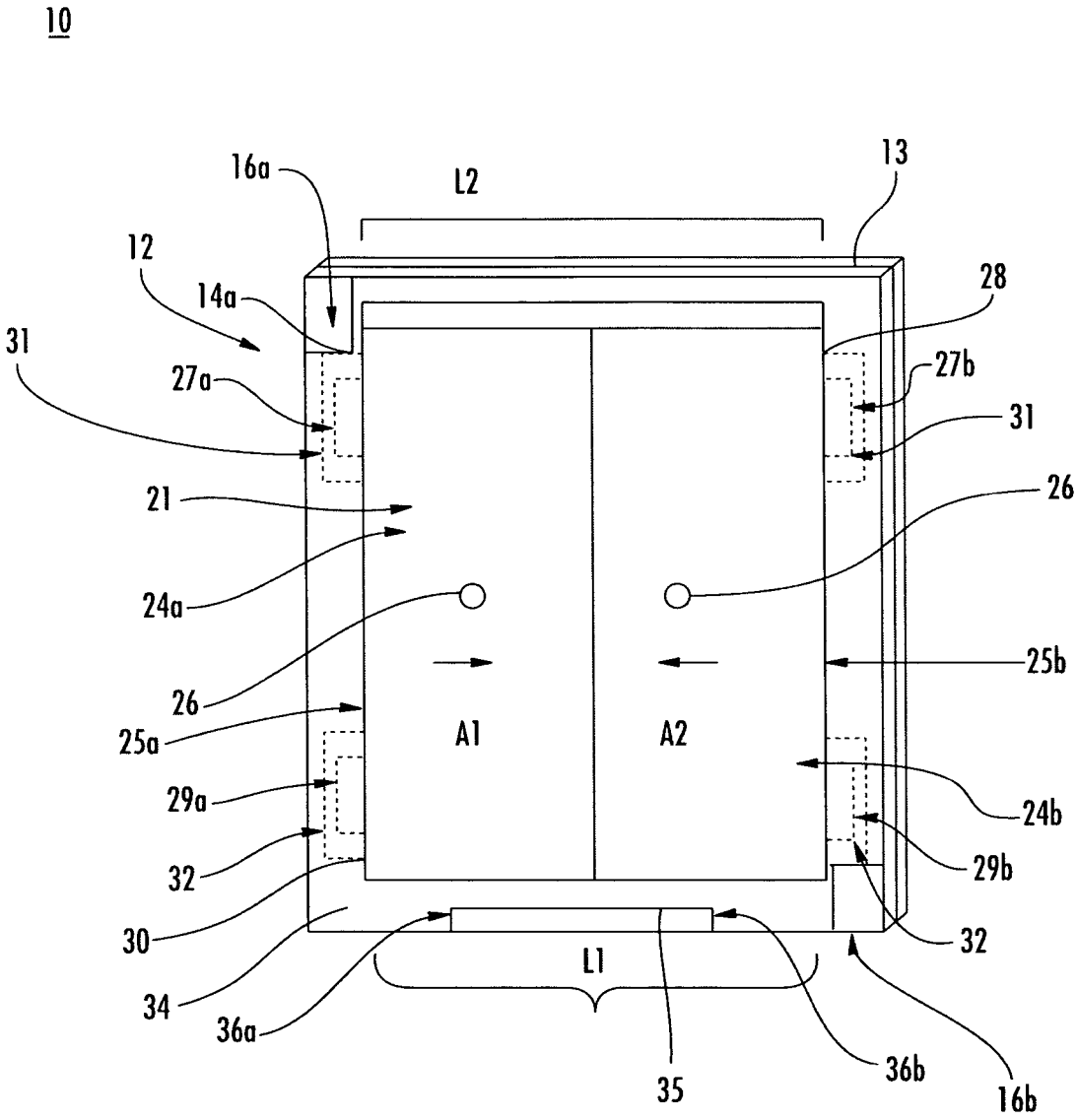
FIG. 1 is a schematic diagram of a revealer device in accordance with the teachings of the game of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIGS. 1-4 are schematic diagrams of revealer device 10 for gradually revealing values of a game piece in accordance with the teachings of the present invention. Housing 12 includes slot 13 for receiving game piece 14. Housing 12 can have a thickness which is slightly thicker than game piece 12. For example, housing 12 can have a thickness in the range of about 0.05 inches to about 0.25 inches. In one embodiment, one or more conventional decks of 52 cards can be used as game pieces. In an alternate embodiment, an Ace is used in addition to the numeric cards 2 through 10. In an alternate embodiment, only numeric cards 2 through 10 are used as game pieces. In an alternate embodiment, Mah Jongg tiles can be used as game pieces. A number of Mah Jongg tiles are dealt to a player. Each of the Mah Jongg tiles is assigned the same point value as the values on the face of the Mah Jongg tiles.

Housing 12 can have a shape matching game piece 14. For example, housing 12 can be rectangular, square, round or oval. Alternatively, housing 12 can have a shape which is different from game piece 14. Housing 12 can include opaque corners 16*a* and 16*b*. Opaque corners 16*a* and 16*b* are used to cover respective corners 15*a* and 15*b* of game piece 14, such as a conventional card. Corners 15*a* and 15*b* of game piece 14 typically include a representation of the value of the card 17 and a representation of a suit 18, such as shown in FIGS. 2A-2J.

For example, game pieces 14 can be a conventional deck of cards or ten cards or subset thereof, such as an ace, two, three, four, five, six, seven, eight, nine or ten. Each game piece 14 can have a representative of a suit 18 located in one or more of outer columns 19*a*, 19*c* or inner column 19*b* of game piece 14. Alternatively, game piece 14 can include other types of markings located in one or more outer columns 19*a*-19*c* or inner column 19*b*.

Figure 2A:
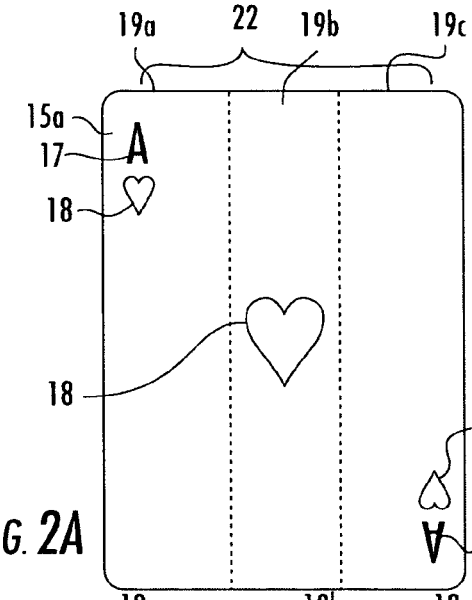

Referring to FIG. 1, housing 12 includes opaque center section 21. Opaque center section 21 covers center section 22 of game piece 14 for covering all representatives of a suit 18 of game piece 14, as shown in FIG. 2A. Opaque center section 21 can include a pair of movable doors 24*a*, 24*b*. Movable doors 24*a*, 24*b* can be retained within tracks 25*a* and 25*b*. For example, the distance between track 25*a* and track 25*b* has a length $L_1$ which is the same as the length $L_2$ of opaque center section 21.

Figure 3:
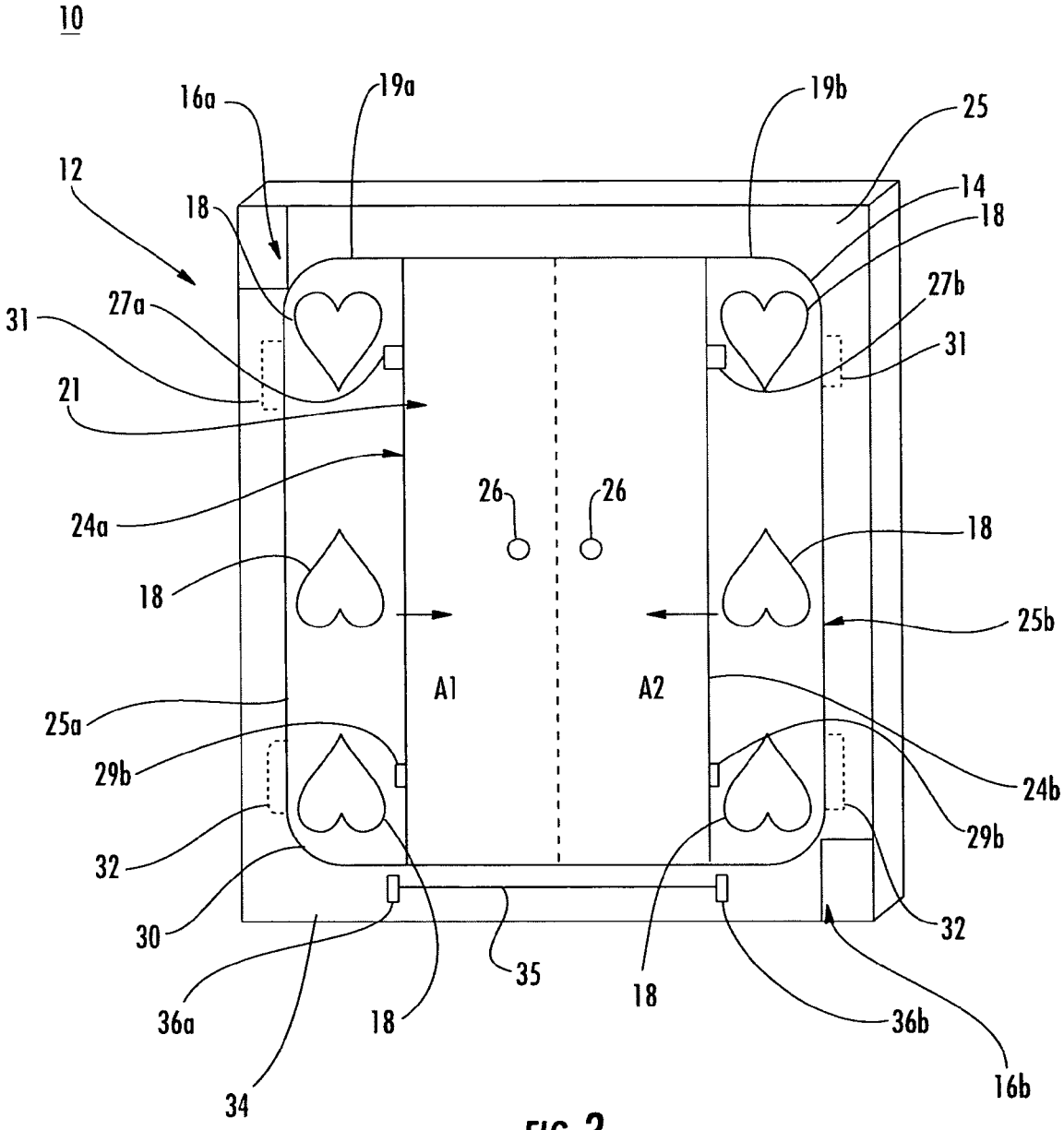
FIG. 3 is a schematic diagram of the device upon movement of movable doors in a horizontal direction.

Protrusion 26 can extend from movable doors 24*a*, 24*b*. Protrusion 26 can be pressed against by a user's finger for moving movable doors 24*a*, 24*b* towards one another in a lateral direction of arrows $A_1$ and $A_2$. Upon moving of movable doors 24*a*, 24*b* toward one another, one of movable doors 24*a*, 24*b* can slide under the other one of movable doors 24*a*, 24*b* and outer columns 19*a* and 19*c* of game piece 14 are revealed, as shown in FIG. 3.

Figure 2D:
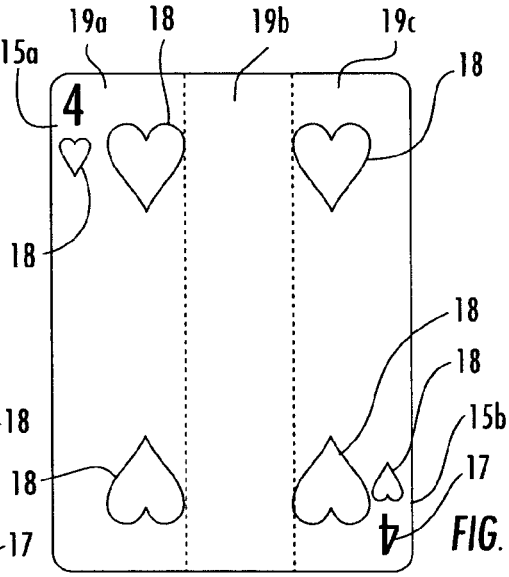
Figure 2B:
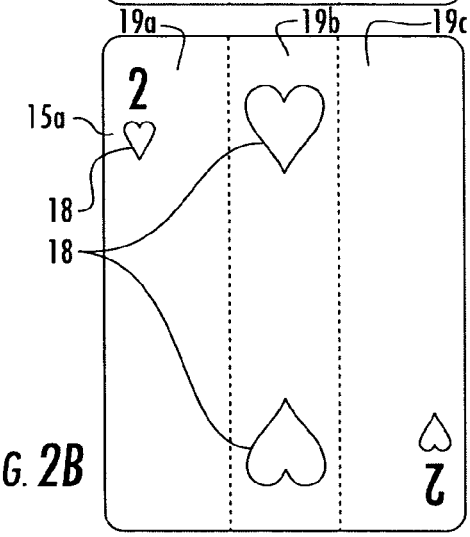
Figure 2E:
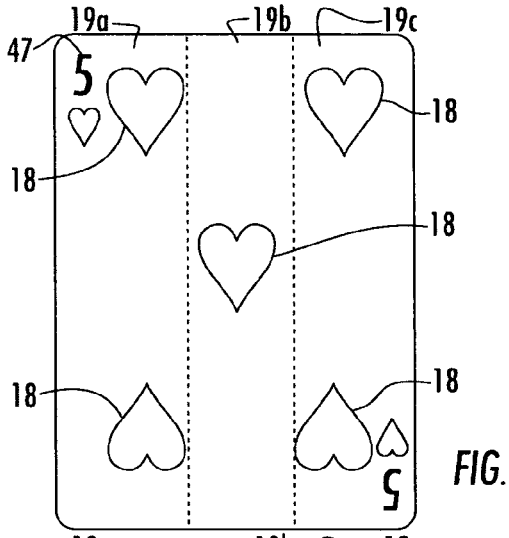
Figure 2C:
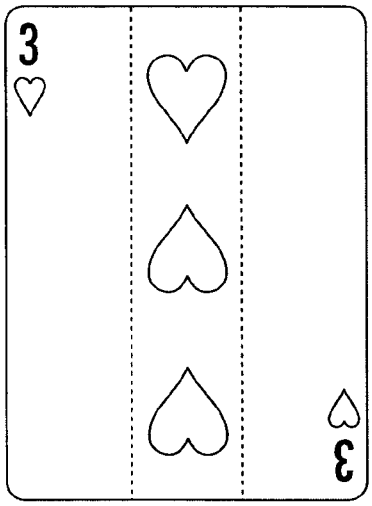
Figure 2F:
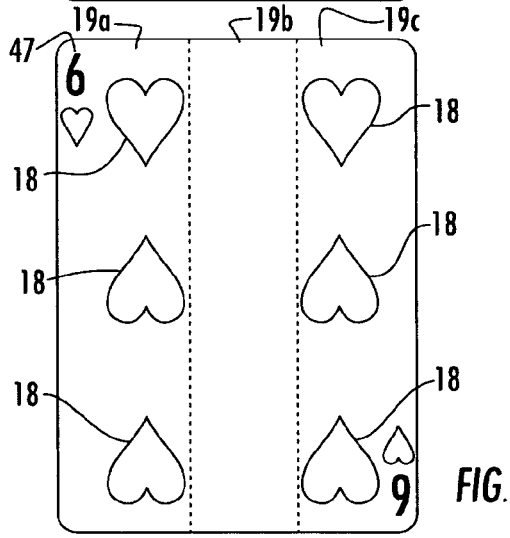

In this example, game piece 14 includes three representatives of a suit 18 in each of outer columns 19*a* and 19*c*. Accordingly, game piece 14 cannot be an Ace, 2 or 3, since these game pieces do not have a representative of a suit 18 located in outer column 19*a* and 19*c*, as shown in respective FIGS. 2A-2C. Game piece 14 also cannot be a 4 or 5 since these game pieces have two representatives of a suit 18 located in outer columns 19*a* and 19*c*, as shown in FIGS. 2D and 2E. Game piece 14 cannot be a 9 or 10 since these game pieces each have four representatives of a suit 18 located in outer columns 19*a* and 19*c*, as shown in FIGS. 21 and 2J. Accordingly, game piece 14 can be either a 6, 7 or 8 since these game pieces each have three representatives of a suit 18 located in outer columns 19*a* and 19*c*, as shown in FIGS. 2F, 2G and 2H.

Referring to FIG. 1, housing 12 includes pins 27*a*, 27*b* adjacent top portion 28 of movable doors 24*a*, 24*b* and pins 29*a*, 29*b* adjacent bottom portion 30 of movable doors 24*a*, 24*b*. Pins 27*a*, 27*b* are received in slot 31 of housing 12. Pins 29*a*, 29*b* are received in slot 32 of housing 12. Pins 27*a*, 27*b* and pins 29*a*, 29*b* retain movable doors 24*a*, 24*b* in the closed position shown in FIG. 1.

Figure 4:
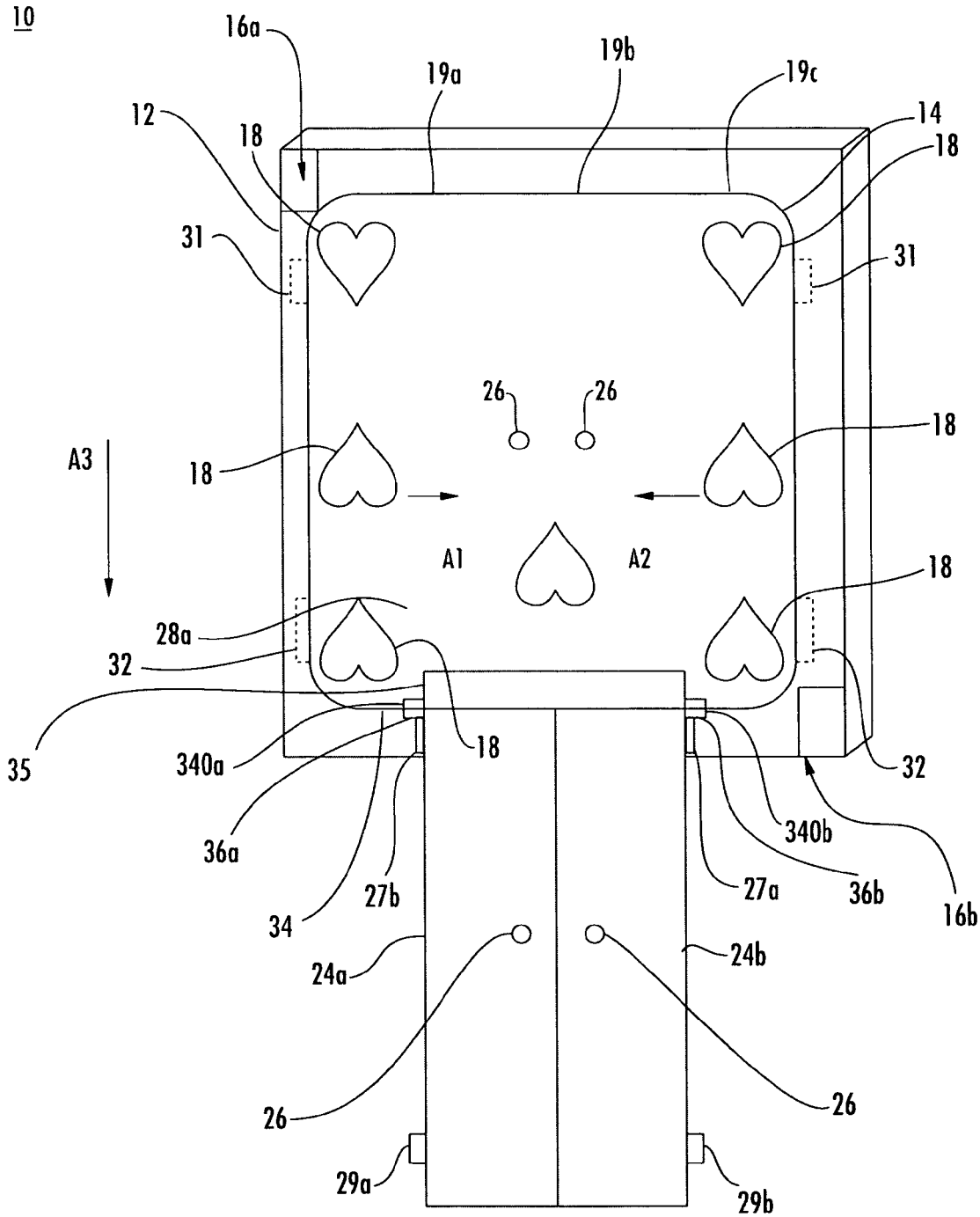
FIG. 4 is a schematic diagram of the device upon movement of movable doors in a vertical direction.

Referring to FIG. 4, during playing of a game, upon movement of movable doors 24*a*, 24*b* toward one another in the lateral direction, pins 27*a*, 27*b* and pins 29*a*, 29*b* are released from respective slots 31 and 32 to allow movable doors 24*a*, 24*b* to slide in a vertical direction of arrow $A_3$ for gradually revealing representatives of a suit 18 located in inner column 19*b* of game piece 14. Movable doors 24*a*, 24*b* can slide vertically within track 35 positioned at bottom 34 of housing 12. Stops 340*a*, 340*b* are positioned at top portion of movable doors 24*a*, 24*b*. Upon movement of movable doors 24*a*, 24*b* in the vertical direction to bottom 34 of housing 12, stops 340*a*, 340*b* contact edge 36*a*, 36*b* of track 35 to prevent movable doors 24*a*, 24*b* from being removed from housing 12.

In this example, as movable doors 24*a*, 24*b* move in the vertical direction, inner column 19*b* is gradually revealed to show one representative of a suit 18 in inner column 19*b*, as shown in FIG. 4. Game piece 14 cannot be a 6 since this game piece does not have a representative of a suit 18 in inner column 19*b*, as shown in FIG. 2F. Accordingly, game piece 14 is a 7 because this game piece has representative of a suit 18 located in inner column 19*b*, as shown in FIG. 2G.

Figure 5:
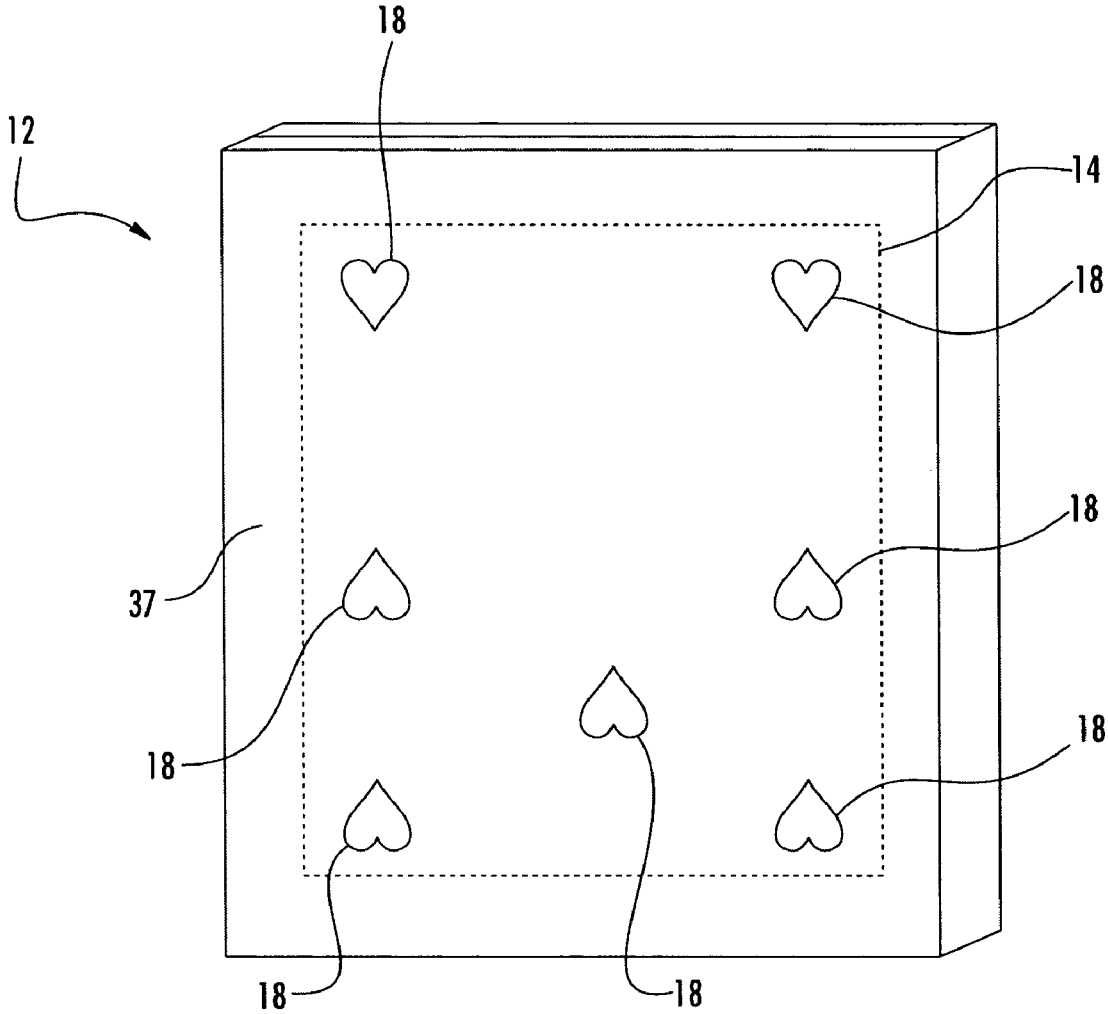
FIG. 5 is a schematic diagram of a rear of the device.

In one embodiment, a pair of game pieces 14 having the same value can be received in slot 13. Game pieces 14 are placed back to back to show representatives of a suit 18 on either side of revealer device 10, as shown in FIG. 5. Rear housing 37 is transparent for showing the value of the one of game pieces 18 through rear housing 37. Accordingly, if a player does not want to gradually reveal game piece 14, the user can flip over revealer device 10 for revealing game piece 14.

Figure 6:
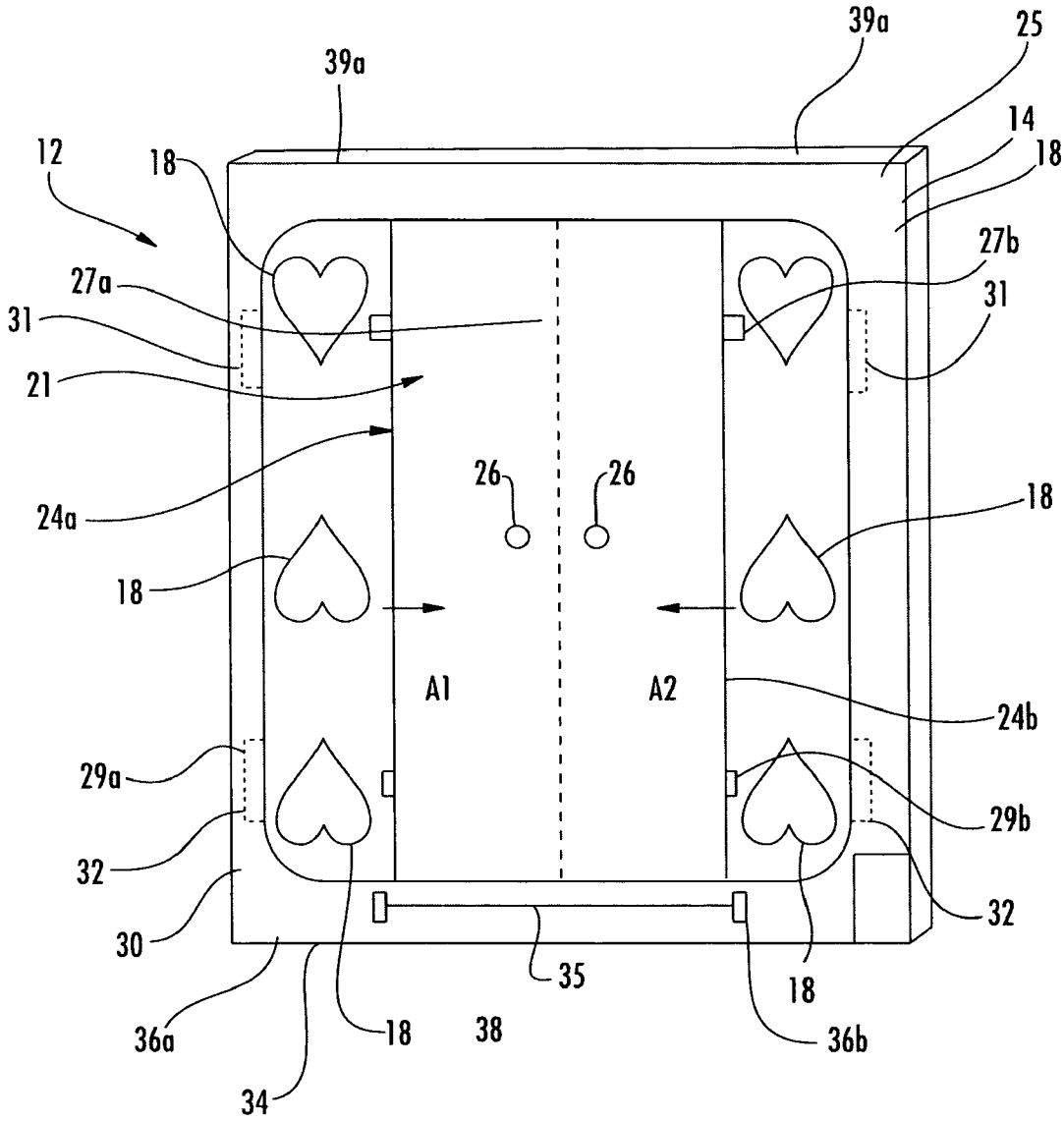
FIG. 6 is a schematic diagram of an alternate embodiment of the device upon movement of movable doors in a horizontal direction.
Figure 7:
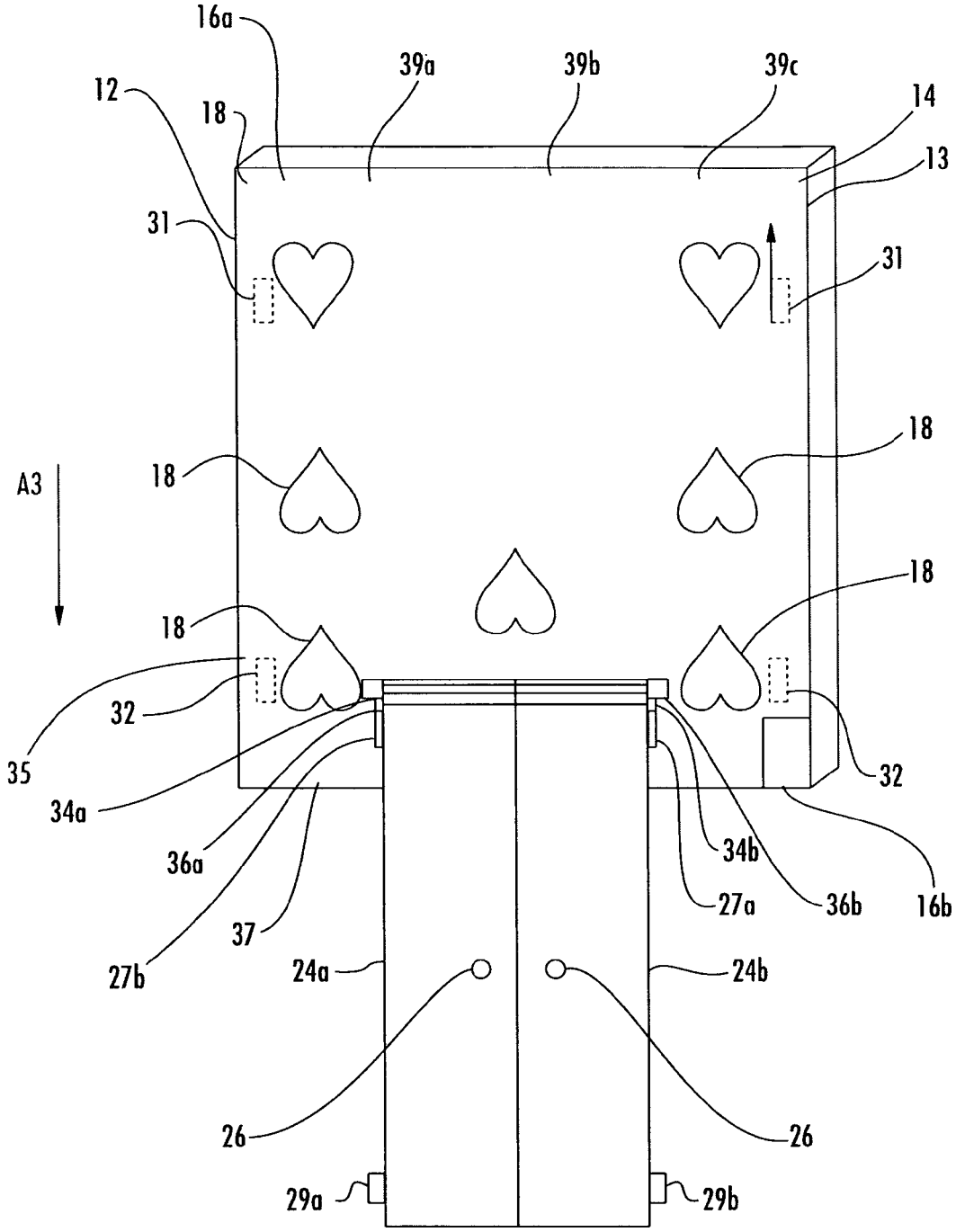
FIG. 7 is a schematic diagram of an alternate embodiment upon movement of movable doors in a vertical direction.
Figure 8:
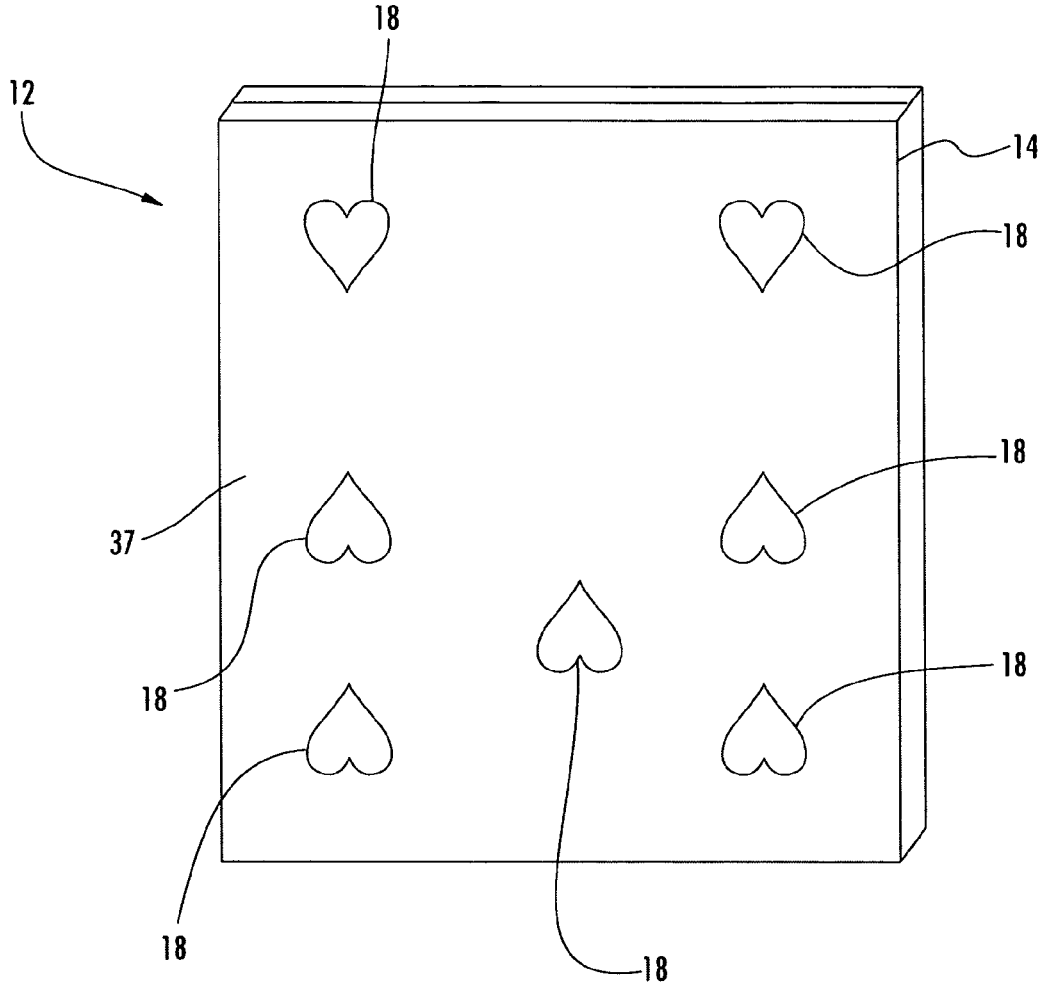
FIG. 8 is a schematic diagram of a rear of the device shown in FIG. 6.
Figure 9:
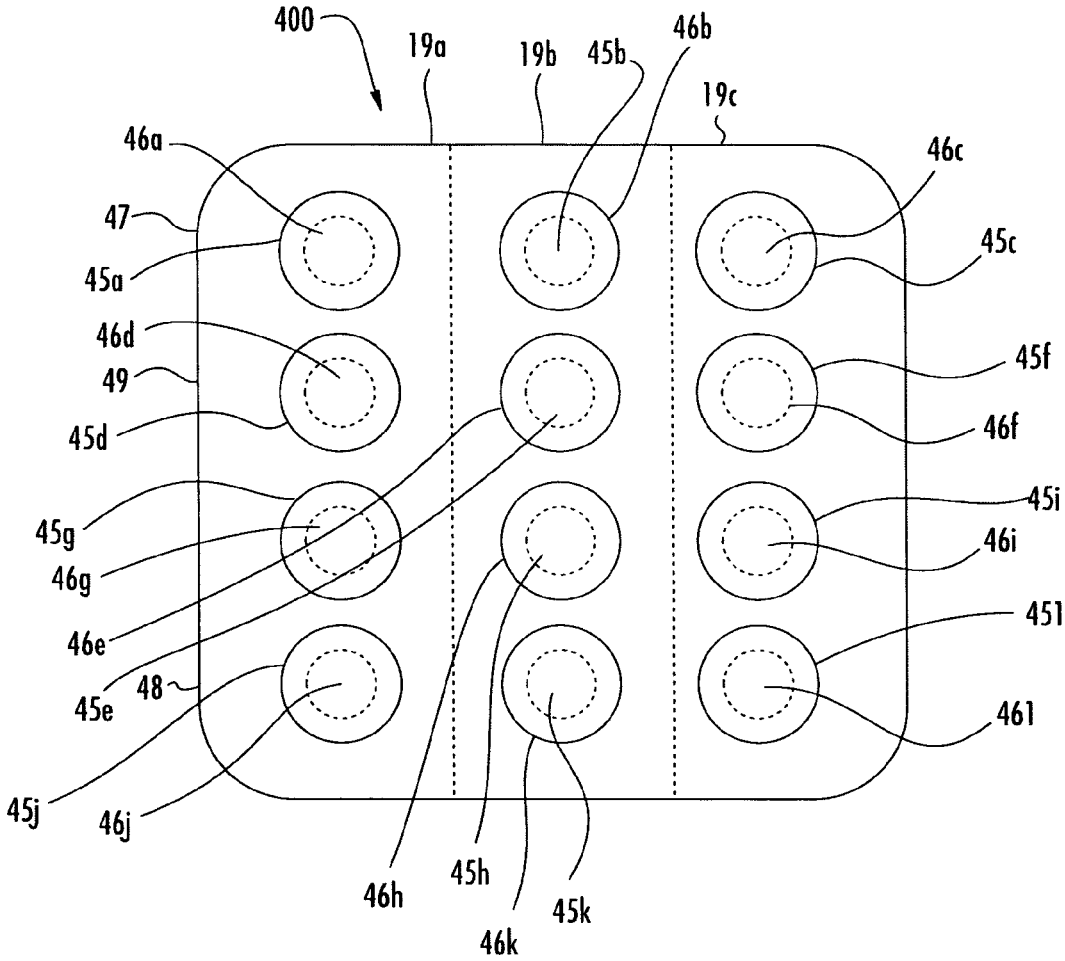
FIG. 9 is a schematic diagram of an alternate embodiment of a device which can be used with a game.

In an alternate embodiment, representative of a suit 18 or markings related to game piece 14 are marked on inner housing 38. For example, representatives of a suit 18 can be imprinted or stamped on inner housing 38 in columns 39*a*-39*c*, as shown in FIGS. 6-7. In this embodiment, game piece 14 is not received in housing 12. Upon moving of movable doors 24*a*, 24*b* toward one another, one of movable doors 24*a*, 24*b* slides under the other one of movable doors 24*a*, 24*b* and outer columns 39*a*-39*c* of inner housing 38 are revealed as shown in FIG. 6. Movable doors 24*a*, 24*b* can slide vertically within track 35 positioned at bottom 34 of housing 12 for gradually revealing representatives of a suit 18 located in inner column 39*b* of inner housing 38 as shown in FIG. 8. The same representatives of a suit 18 which are coupled to inner housing 38 can be coupled to rear housing 37 as shown in FIG. 9. In an alternate embodiment, revealed device includes representative of a suit 18 integral with rear housing 37.

In an alternate embodiment, revealer device 40 can be used with game pieces 14 as shown in FIG. 9. For example, game pieces 14 can be cards 2 through 10 and an Ace as shown in FIGS. 2A-2J. During playing of a game, game piece 14 slides into or is placed under revealer device 40. For example, a dealer can slide game piece 14 into revealer device 40 or place game piece 14 under revealer device 40.

Revealer device 40 can include one or more of opaque portions 45*a*-*l* positioned relative to columns 19*a*-19*c* to cover the representation of a suit or markings of game piece 18, as shown in FIGS. 2A-2J. Referring to FIG. 9, opaque portions 45*a*-*l* can be individually rotated or slid to reveal transparent portions 46*a*-*l* positioned respectively directed beneath opaque portions 45*a*-*l*. Upon revealing of each transparent portion 46, the corresponding representative of a suit 18 or marking underneath each transparent portion 46 is shown. The number of opaque portions 45*a*-*l* corresponds to the highest number of representative of a suit 18 or markings on the game piece. For example, there can be ten opaque portions 45 to cover ten representative markings of a suit on a game piece having a value of ten. In one embodiment, revealer device 40 can be formed of plastic including opaque plastic discs to form opaque portions 45 which are hinged to transparent plastic portions to form transparent portions 46.

The selection of the order for revealing opaque portions 45*a*-*l* can be selected by the player or can be a predetermined order. For example, during play, if opaque portion 45*a* is selected, revealing of transparent portion 46*a* shows whether or not a representative of a suit 18 is shown in column 19*a* underneath transparent portion 46*a* at upper portion 47 of game piece 14. Game pieces of 4, 5, 6, 7, 8 and 9 have a representative of a suit positioned underneath transparent portion 46*a* at upper portion 47 of game piece 14, as shown in respective FIGS. 2D-2J. Accordingly, if a representative of a suit is positioned in column 19*a*, game piece 14 can not be an Ace, 2 or 3. Subsequently, if opaque portion 45*j* is selected, transparent portion 46*j* shows whether or not a representative of a suit is shown at lower portion 48 in column 1 of game piece 14. Accordingly, if a representative of a suit is shown at 47*d*, game piece 14 can be either a 7, 8, 9 or 10, as shown in FIGS. 2I and 2J. Subsequently, if opaque portion 45*g* is selected, transparent portion 46*g* shows whether or not a representative of a suit is shown at upper middle portion 49 of column 19*a* of game piece 14. Accordingly, a representative of a suit is shown at 45*g*, game piece 14 can be either a 9 or a 10. Subsequently, if opaque portion 45*e* is selected, transparent portion 46*e* shows whether or not a representative of a suit 18 is shown at upper middle portion 49 of column 19*b*. Accordingly, if a representative of a suit is shown at upper middle portion 49 of column 19*b*, game piece 14 can be a 10. Various starting selections of opaque portions 45*a-l* can be used and the subsequent selection of opaque portions 45*a-l* can be determined until the value of game piece 14 is revealed.

Figure 10A:
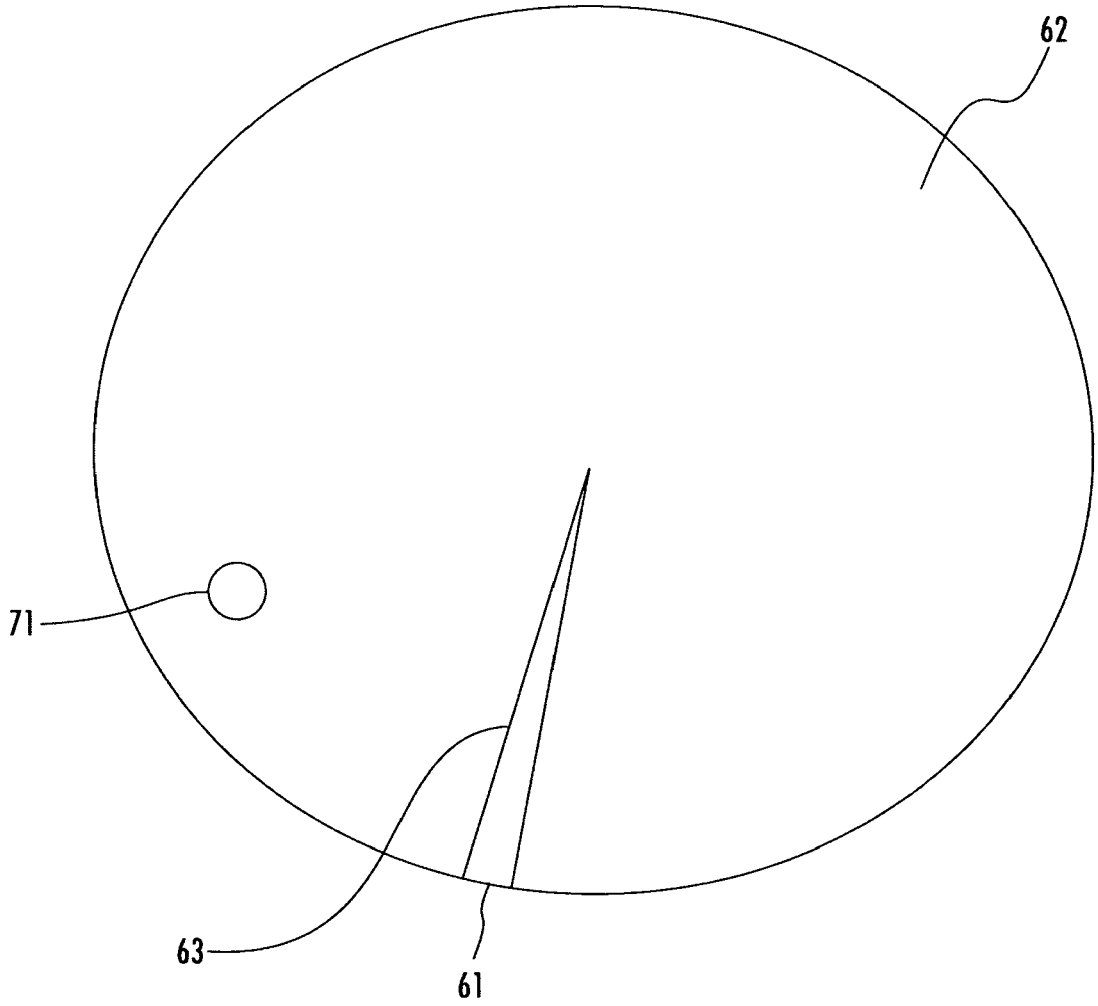
FIG. 10A is a schematic diagram of an alternate embodiment of a device which can be used with a game piece.
Figure 10B:
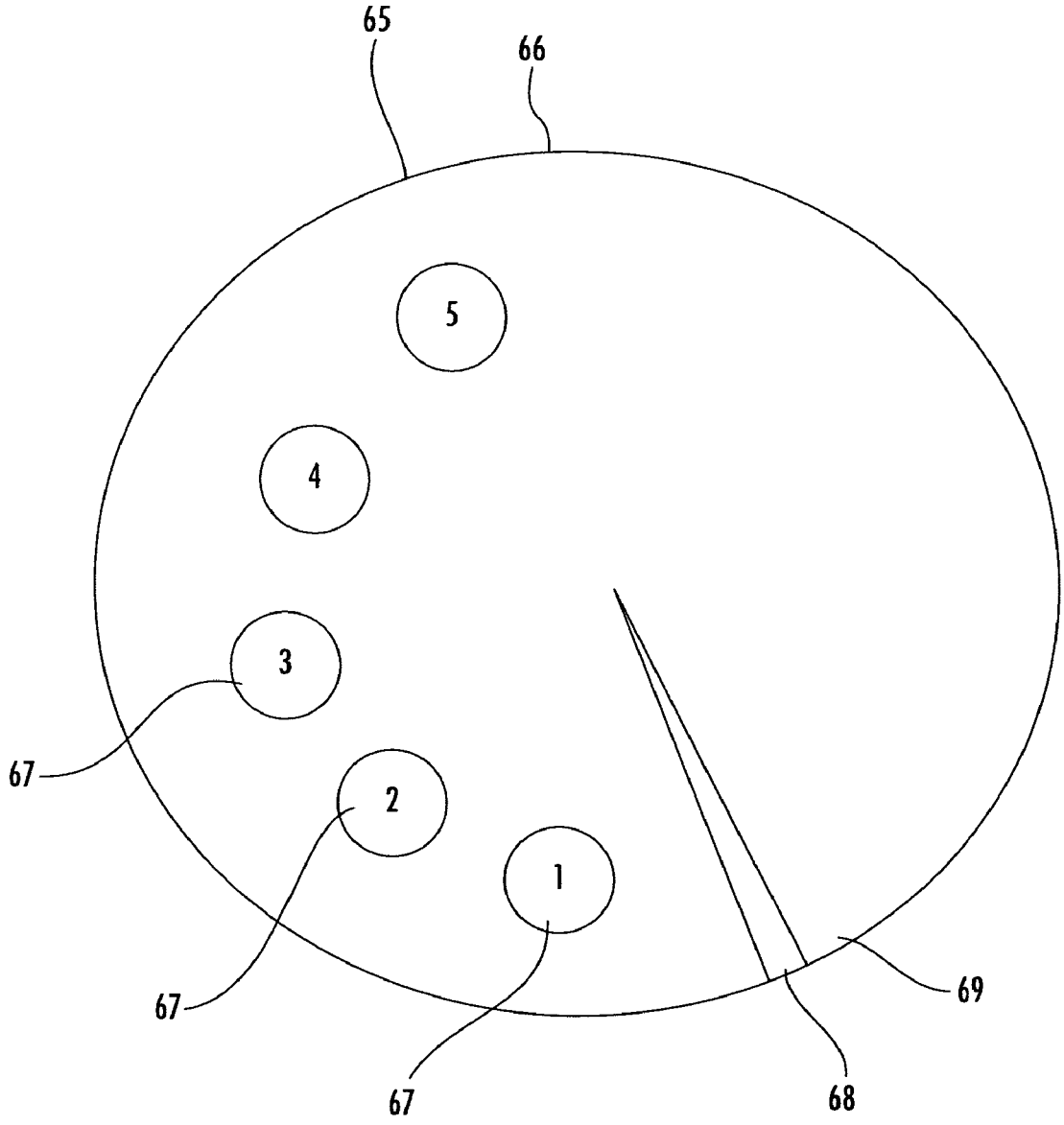
FIG. 10B is a schematic diagram of a game piece which can be used with the device of FIG. 10A.
Figure 10C:
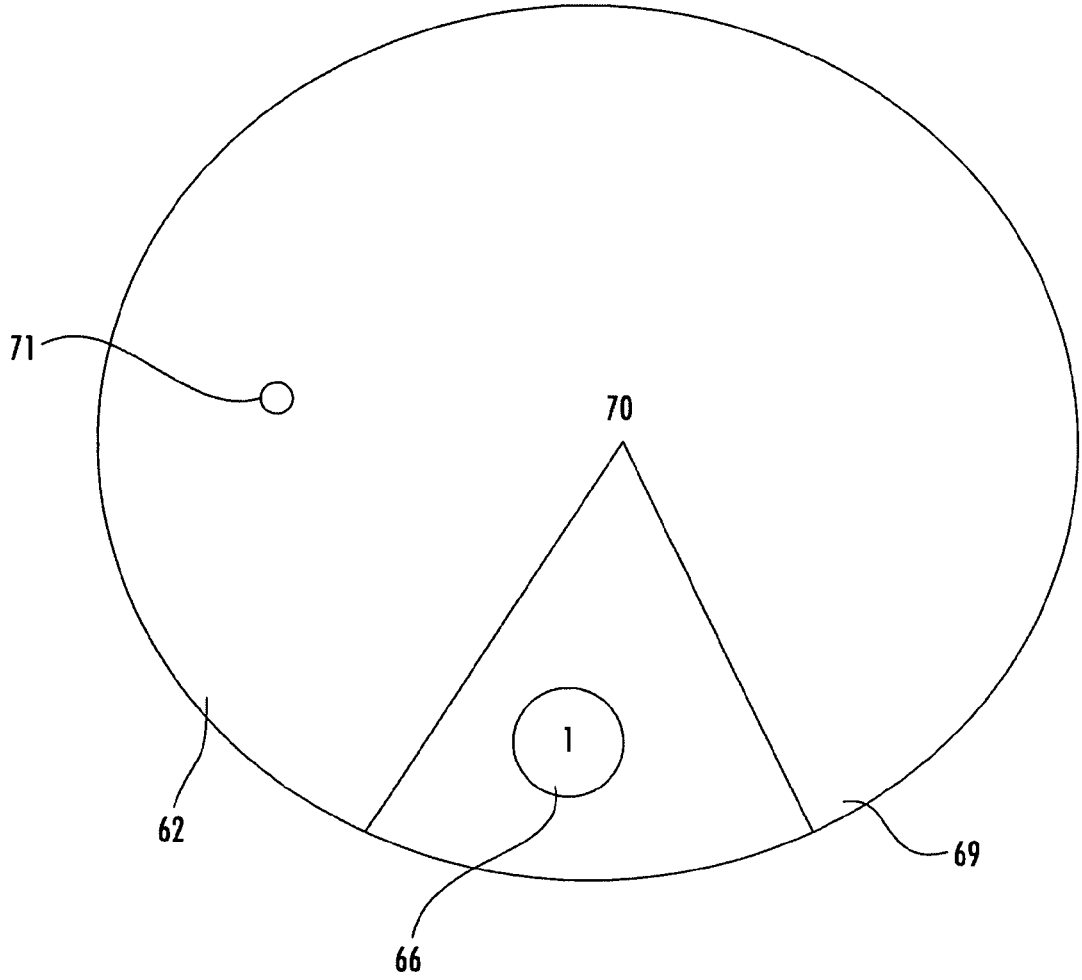
FIG. 10C is a schematic diagram of the device and game piece during play.

In an alternate embodiment, revealer device 60 comprises circular housing 62 as shown in FIG. 10A. Circular housing 62 includes slot 63. Slot 63 extends radially from edge 61 to center 64 of circular housing 62. Circular game piece 65 comprises circular body 66, as shown in FIG. 10B. Values 67 are formed on circular game piece 65. Circular game piece 65 includes slot 68. Slot 68 extends radially from edge 69 to center 70 of circular game piece 65. During playing, slot 63 of circular housing 62 is received in slot 68 of circular game piece 65 such that circular housing 62 covers circular game piece 65. Circular housing 62 is rotated to gradually uncover values 67 of circular game piece 65, as shown in FIG. 10C. Indentation 71 can be formed in circular housing 62 for receiving a digit or thumb to push against circular housing 62 for rotation of circular housing 62 over circular game piece 65.

For example, circular housing 62 and circular game piece 65 can be formed of plastic, cardboard, laminated cardboard or paper, such as a material used in a conventional card.

Figure 11A:
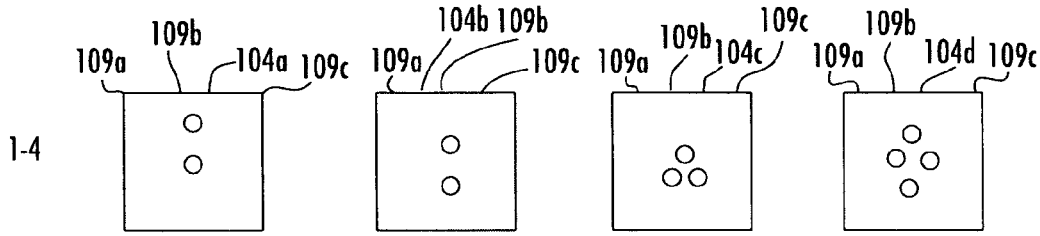
FIGS. 11A-11C are schematic diagrams of game pieces which can be used with the device of the present invention.
Figure 11B:
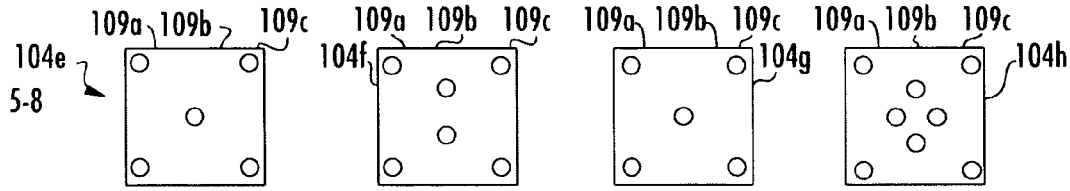
Figure 11C:
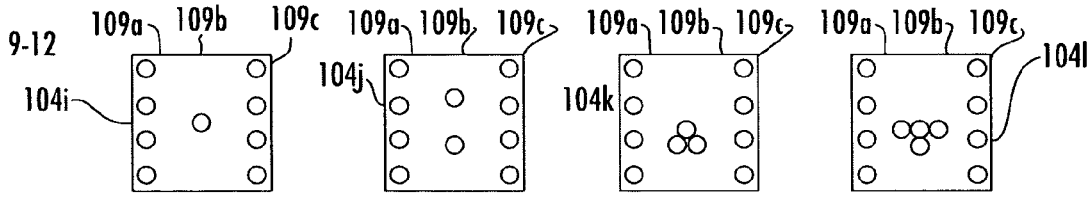

In an alternate embodiment, game piece 104 can be used as game pieces with revealer device 10 or revealer device 40. Game pieces 104*a*-104*l* include one or more markings in outer columns 109*a* and 109*c* or inner column 109*b*, as shown in FIGS. 11A-11C. For example, each of game pieces 104*a*-104*l* include one or more markings in inner column 109*b*. Game pieces 104*a*-104*l* each have a respective value 1 through 4 in inner column 109*b*. Game pieces 104*a*-104*d* do not have marking in outer columns 109*a*-109*c* and each have a respective value 1 through 4 in inner column 109*b* resulting in respective values 1 through 4. Game pieces 104*e*-104*h* each have two markings in each of outer columns 109*a* and 109*c* and each have a respective value 1 through 4 in inner column 109*b* resulting in respective values 5 through 8. Game pieces 104*i*-104*j* each have four markings in each of columns 109*a* and 109*c* and each have a respective value 1 through 4 in inner column 109*b* resulting in respective values 9 through 12.

In alternate embodiments, revealer device 10, revealer device 40 and revealer device 60 can be used with any card game, such as, for example, blackjack, poker or baccarat for increasing excitement of the game. In alternate embodiments, revealer device 10 and revealer device 60 can be formed of a material having sufficient weight such that the device can be used in an outdoor environment.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A revealer device for revealing a marking of a game piece comprising:

a game piece having at least one marking;

a housing for receiving said game piece, said housing including an opaque portion for covering at least a portion of said game piece, said opaque portion being movable for gradually revealing at least one marking on said at least one portion of said game piece, wherein said opaque portion comprises:

a pair of movable doors, said movable doors being movable toward one another into an open position for revealing said at least one marking on one or more outer portions of said game pieces.

2. The revealer device of claim 1 wherein said housing further comprises:

an opaque corner portion for covering a corner portion of said game piece.

3. The revealer device of claim 1 further comprising:

a protrusion extending from each of said movable doors.

4. The revealer device of claim 1 wherein upon movement of said movable doors towards one another said movable doors can be moved in a vertical direction for revealing said at least one marking on an inner portion of said game piece.

5. The revealer device of claim 1 further comprising:

a track in said housing, said track receiving said movable doors during said movement in said vertical direction.

6. The revealer device of claim 5 further comprising:

a stop positioned at said top position at each of said movable doors, said stop contacting an edge of said track to prevent said movable doors from being removed from said housing.

7. The revealer device of claim 1 further comprising:

retaining means for retaining said doors in a closed position before said doors being movable into said open position.

8. The revealer device of claim 7 wherein said retaining means comprises:

a pair of pins positioned adjacent a top and bottom portion of each of said movable doors and a slot in said top and bottom portion of each of said housing adjacent said top and bottom portion of each of said movable doors, respective said slots receiving respective said pins.

9. The revealer device of claim 1 wherein said rear of said housing is transparent and said housing receiving a second game piece.

10. The revealer device of claim 1 wherein said game piece is a card and said at least one marking is a representative of a suit.

11. A revealer device for revealing a marking of a game piece comprising:

a game piece having at least one marking;

a housing including an opaque portion for covering an inner portion of said housing, at least one said marking being marked on said inner housing, said at least one marking being a representative of said game piece, said opaque portion being movable for gradually revealing said at least one marking, wherein said opaque portion comprises:

a pair of movable doors, said movable doors being movable toward one another into an open position for revealing said at least one marking on one or more outer portions of said inner housing.

12. The revealer device of claim 11 further comprising:

a protrusion extending from each of said movable doors.

13. The revealer device of claim 11 further comprising:

retaining means for retaining said doors in a closed position before said doors being movable into said open position.

14. The revealer device of claim 13 wherein said retaining means comprises:

a pair of pins positioned adjacent a top and bottom portion of each of said movable doors and a slot in said top and bottom portion of each of said housing adjacent said top and bottom portion of each of said movable doors, respective said slots receiving respective said pins.

15. The revealer device of claim 11 wherein a second set of said at least one marking being coupled to a rear of said housing.

16. The revealer device of claim 11 wherein said at least one marking is a representative of a suit.

17. The revealer device of claim 11 wherein said at least one marking is imprinted or stamped on said inner housing.

18. A revealer device for revealing a marking of a game piece comprising:

a game piece having at least one marking;

a housing including an opaque portion for covering an inner portion of said housing, at least one marking being marked on said inner housing, said at least one marking being a representative of said game piece, said opaque portion being movable for gradually revealing said at least one marking, wherein said opaque portion comprises:

a pair of movable doors, said movable doors being movable toward one another into an open position for revealing said at least one marking on one or more outer portions of said inner housing wherein upon movement of said movable doors towards one another said movable doors can be moved in a vertical direction for revealing said at least one marking on an inner portion of said inner housing.

19. The revealer device of claim 18 further comprising:

a track in said housing, said track receiving said movable doors during said movement in said vertical direction.

20. The revealer device of claim 19 further comprising:

a stop positioned at said top position at each of said movable doors, said stop contacting an edge of said track to prevent said movable doors from being removed from said housing.

* * * * *